US006364729B1

(12) United States Patent
Khanamirian

(10) Patent No.: US 6,364,729 B1
(45) Date of Patent: Apr. 2, 2002

(54) PERSONAL FLOTATION DEVICE WITH FRONT PORTION CENTRAL PULL SYSTEM

(75) Inventor: Alexander Khanamirian, Miami Beach, FL (US)

(73) Assignee: Extrasport, Inc., Miami, FL (US)

( * ) Notice: Subject to any disclaimer, the term of this patent is extended or adjusted under 35 U.S.C. 154(b) by 0 days.

(21) Appl. No.: 09/637,972

(22) Filed: Aug. 11, 2000

(51) Int. Cl.[7] ..... B63C 9/115
(52) U.S. Cl. ..... 441/115; 441/117
(58) Field of Search ..... 441/106, 114–119; D21/804, 805

(56) References Cited

U.S. PATENT DOCUMENTS

| | | | | |
|---|---|---|---|---|
| 1,114,739 A | | 10/1914 | Dobinch | D21/238 |
| 1,511,006 A | | 10/1924 | Prescott | D21/238 |
| 1,617,061 A | * | 2/1927 | La Pierre | 441/117 |
| 4,047,255 A | * | 9/1977 | Kiefer | 441/106 |
| D280,844 S | | 10/1985 | Evert | D21/238 |
| 4,545,773 A | | 10/1985 | Evert | D21/238 |
| 4,660,751 A | | 4/1987 | von Dewitz | D21/238 |
| 4,860,936 A | | 8/1989 | Lowe | D21/238 |
| 5,586,705 A | | 12/1996 | Leonard | |
| 5,662,433 A | | 9/1997 | Seligman | D21/238 |
| 5,690,413 A | | 11/1997 | Coughlin | |
| 5,746,632 A | | 5/1998 | Theberge | |

* cited by examiner

*Primary Examiner*—Sherman Basinger
(74) *Attorney, Agent, or Firm*—Foley & Lardner

(57) ABSTRACT

A personal flotation device for being worn by a user includes a buoyant back body portion, a buoyant front body portion opposite the back portion, first and second straps coupled to the back body portion and converging into a third strap, and a fastener coupled to the front body portion. The fastener is configured to engage the third strap at various points to vary spacing between the front body portion and the back body portion.

25 Claims, 2 Drawing Sheets

PERSONAL FLOTATION DEVICE WITH FRONT PORTION CENTRAL PULL SYSTEM

FIELD OF THE INVENTION

The present invention relates generally to personal flotation devices commonly referred to as life jackets or life vests. In particular, the present invention relates to a personal flotation device that is easily adjustable to accommodate users having differently sized and shaped torsos.

BACKGROUND OF THE INVENTION

Personal flotation devices, commonly referred to as life jackets or life vests, are generally worn by individuals during water sports or boating activities to provide the individual with increased buoyancy in the water. Such personal flotation devices or "PFDs" have evolved over the years from the old "Mae West" or kapok type of life vests to vinyl-covered foam rubber life jackets and to more specialized flotation devices used for different types of water sports or boating activities. Personal flotation devices typically include a body formed as a vest which is adapted to fit over and about the torso of a wearer. The body of the PFD typically includes a back section and a front section interconnected by integral shoulder sections which are configured to extend over opposite shoulders of the wearer. Such PFDs also include generally inflexible straps which extend between the back section and the front section along the user's sides. The straps are typically adjustable to accommodate users having differently sized torsos.

Although such PFDs are very common, such PFDs are frequently uncomfortable to wear. Because the shoulder sections of such PFDs are permanently affixed to the back section and the front section, the shoulder sections cannot be easily adjusted. As a result, the upper portions of the back section and the front section do not properly conform to the particular characteristics of the user, thereby causing discomfort.

Other personal flotation devices are provided with a pair of adjustable shoulder straps. However, such adjustable shoulder straps still fail to adequately bring the front section into conformance with the particular characteristics of the wearer since such shoulder straps generally do not overlap the front section, but merely extend between the upper edges of the front section and the back section. In addition, such adjustable shoulder straps are extremely difficult to reach for the user and are tedious and time consuming to adjust.

As a result, there is a continuing need for a PFD that is comfortable to wear, that conforms to the particular characteristics of the torso of the wearer and that is easily adjusted.

SUMMARY OF THE INVENTION

The present invention provides a personal flotation device that includes a buoyant back body portion, a buoyant front body portion opposite the back portion, first and second straps coupled to the back body portion and converging into a third strap, and a fastener coupled to the front body portion. The fastener is configured to engage the third strap at various points to vary spacing between the front body portion and the back body portion.

The present invention also provides a personal flotation device that includes a buoyant back body portion, a buoyant front body portion, a first side body portion, a second side body portion opposite the first side portion, a first shoulder strap, a second shoulder strap, and an extension strap. The back body portion and the front body portion each include flotation foam. The back body portion is configured to extend adjacent to the user's back while the front body portion is configured to extend opposite the back body portion adjacent the user's front. The first and second side body portions extend opposite one another and connect the back portion and the front portion. The first and second shoulder straps have first ends coupled to the back portion and opposite ends coupled to the extension strap. The extension strap includes a plurality of spaced connecting strap portions selectively connectable to the front portion to selectively adjust spacing between the buoyant back body portion and the buoyant front body portion.

The present invention also provides a personal flotation device that includes a buoyant back body portion, a buoyant front body portion, a first elastic side portion, a second elastic side portion, first and second shoulder straps and a fastener. The back body portion and the front body portion extend opposite to one another and include at least one layer of flotation material. The first elastic side portion extends between the back body portion and the front body portion. The second elastic side portion extends from the back body portion opposite the first side portion. The second elastic side portion is releasably connected to the front body portion. The first and second shoulder straps are coupled to the back body portion and converge into a third extension strap. The fastener is coupled to the front body portion so as to extend along a user's mid-sagital plane when the device is worn by the user. The fastener is configured to selectively engage the third extension strap at various points to vary spacing between the front body portion and the back body portion.

DETAILED DESCRIPTION OF THE PREFERRED EMBODIMENTS

Figure 1:
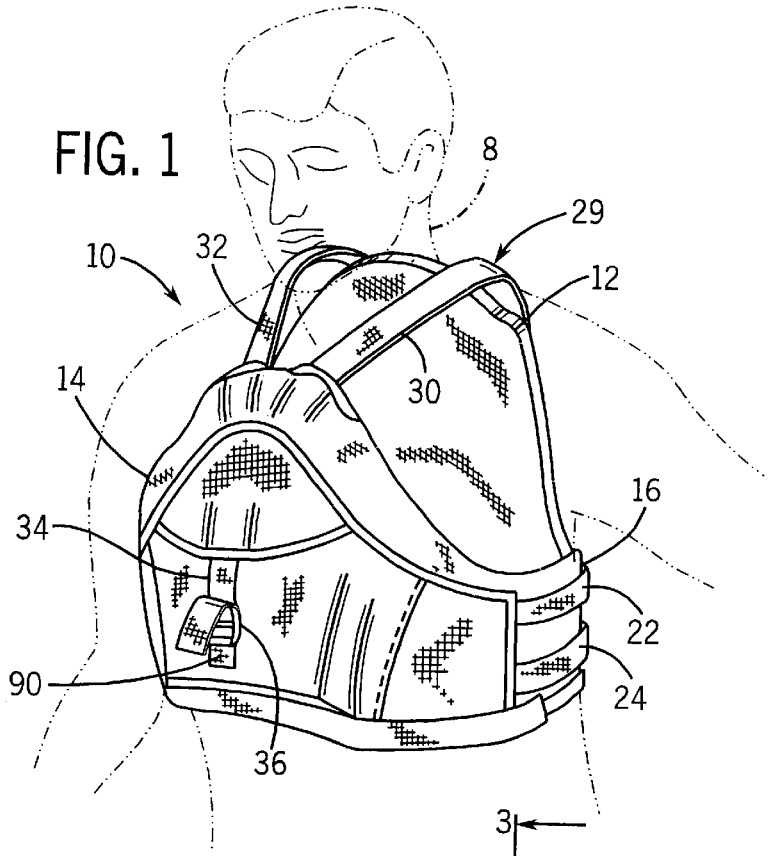
FIG. 1 is a front perspective view of an exemplary personal flotation device of the present invention being worn by a user.
Figure 2:
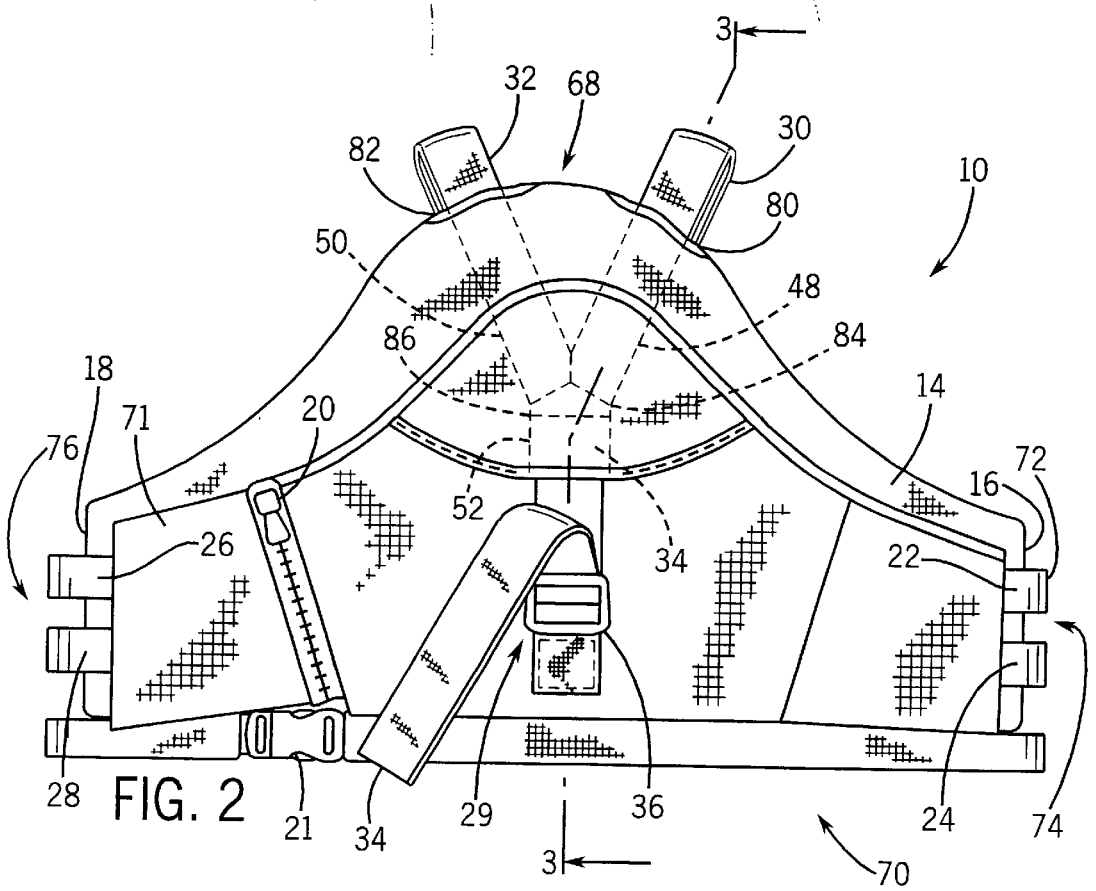
FIG. 2 is a front elevational view of the personal flotation device of FIG. 1.
Figure 3:
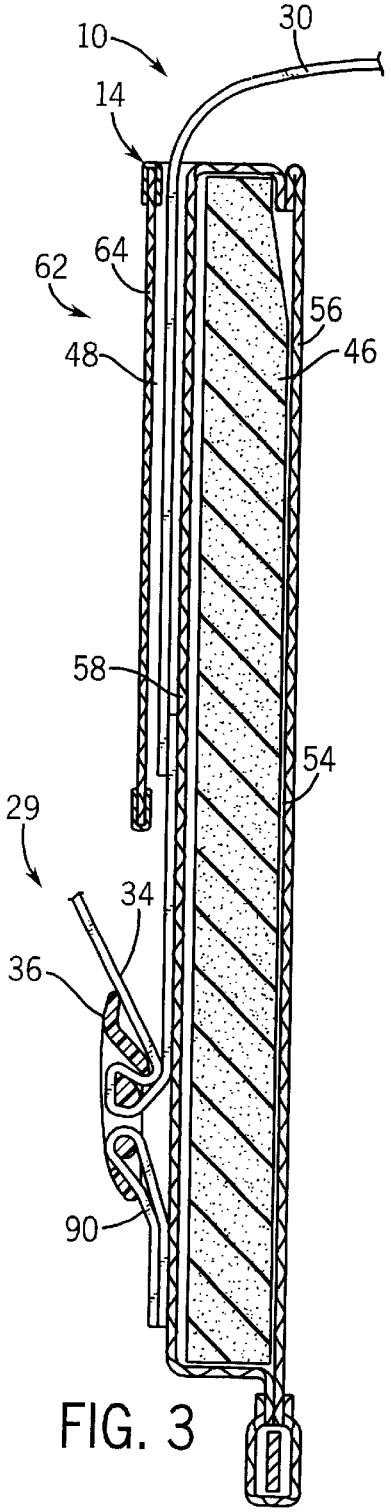
FIG. 3 is a fragmentary sectional view of the personal flotation device of FIG. 2 taken along lines 3—3.

FIGS. 1–3 illustrate personal flotation device 10. FIG. 1 illustrates personal flotation device 10 worn by a user. FIGS. 2 and 3 are front elevational views and sectional views of personal flotation device 10, respectively. As best shown by FIGS. 1 and 2, personal flotation device 10 generally includes back body portion 12, front body portion 14, side body portion 16, side body portion 18, fasteners 20, 21, side adjusters 22, 24, 26, 28, and central pull system 29 including shoulder straps 30, 32, extension strap 34, and fastener 36. Back body portion 12 is configured to extend adjacent to and along back of user 8 when device 10 is worn by user 8 and includes at least one layer 40 (shown in FIG. 3) of buoyant flotation material, such as flotation foam, having a density less than the density of water. Although back body portion 12 is illustrated as including a single layer 40 of flotation material for ease of illustration, back body portion 12 preferably includes multiple layers of layers 40 of flotation material to provide device 10 with an adequate buoyancy.

Front body portion 14 extends opposite back body portion 12 and cooperates with back body portion 12 to buoyantly support user 8 in water. Back body portion 12 and front body portion 14 are coupled to one another by side portions 16, 18 and by shoulder straps 30, 32. Front body portion 14 generally includes flotation layer 46 (shown in FIG. 3) and sleeves 48, 50 and 52. Flotation layer 46 comprises a layer of material having a density less than that of water, such as flotation foam. As best shown by FIG. 3, flotation layer 46 is preferably captured within a pocket 54 formed by fabric layers 56, 58 which are affixed to one another by stitching, adhesive or other means. Alternatively, flotation layer 46 may be permanently affixed to fabric layers 56, 58 and molded to provide appropriate creases and seams such as disclosed in U.S. Pat. No. 6,235,661, issued on May 22, 2001, the full disclosure of which is hereby incorporated by reference.

Although front body portion 14 is illustrated as including a single layer 46 of flotation material for ease of illustration, front body portion 14 preferably includes multiple side-by-side layers of flotation material to provide front body portion 14 with sufficient buoyancy to support user 8. In the exemplary embodiment, the flotation material forming layers 40 and 46 comprises a closed cell polyvinylchloride foam material such as commonly sold under the trademark AIREX. However, other similar flotation materials, such as ethyl vinyl acetate foam, may also be utilized. Such flotation foam materials enable back body portion 12 and front body portion 14 to conform to the body of user 8 without sacrificing buoyancy or comfort. Fabric layers 56 and 58 are preferably formed from a nylon material, such as a 200 denier nylon oxford fabric to provide strength, comfort and water drainage.

Sleeves 48, 50 and 52 comprise elongate passageways formed along the front face 62 of front body portion 14 and configured to receive straps 30, 32 and 34, respectively. As best shown by FIG. 3, sleeve 48 is formed by a panel or layer 64 of fabric sewn or otherwise affixed to layer 58 with opened ends. Sleeves 50 and 52 are formed in a similar manner. As best shown by FIG. 2, sleeves 48 and 50 are spaced from one another at apex 68 of front body portion 14 and are converged together towards base 70 of front body portion 14 to form sleeve 52 which opens slightly above fastener 36. Sleeves 48 and 50 receive and guide shoulder straps 30 and 32, respectively, along front face 62 of front body portion 14. Sleeve 52 receives and guides extension strap 34. As a result, the locations at which shoulder straps 30 and 32 extend from front body portion 14 to back body portion 12 during adjustment is controlled. Moreover, because sleeves 48, 50 and 52 substantially receive straps 30, 32 and 34 from apex 68 to just above fastener 36, straps 30, 32 and 34 are not exposed, preventing undesirable accidental tangling or snagging of straps 30, 32 and 34 and providing front body portion 14 with a more pleasing aesthetic appearance. Although less desirable sleeves 48, 50 and 52 may alternatively comprise simple fabric loops extending at various points along front face 62 of front body portion 14.

Side portion 16 comprises a band of fabric material extending between and affixed to back body portion 12 and front body portion 14. Side portion 16 is configured to extend along a side of user 8 opposite side portion 14. Side portion 16 is preferably flexible so as to permit front body portion 14 and back body portion 12 to move relative to one another along a mid-coronal plane of user 8. In the exemplary embodiment, side portion 16 includes an elastic material, such as NEOPRENE. Alternatively, more suitable materials, including LYCRA (a synthetic fiber produced by E.I. DuPont de Nemours and Company, Wilmington, Del.), DARLEXX (an elastic fabric produced by Darlington Fabrics Corporation, New York, N.Y.) or other stretch materials may be utilized. As a result, side portion 16 stretches to conform to the torso and chest of user 8. Although less desirable, side portion 16 may alternatively comprise simple flexible webbing or straps made of non-generally resilient material such as nylon.

Side portion 18 comprises a band of material extending from back body portion 12 to front body portion 14. Side portion 18 is configured to extend adjacent the side of user 8 opposite side portion 16. As best shown by FIG. 2, side portion 18 includes an overlapping portion 71 and extends adjacent to front face 62 of front body portion 14 and partially overlaps front body portion 14 and secured to front body portion 14 by fastener 20. Side portion 18 is preferably releasably coupled to front body portion 14 by fasteners 20 and 21. Fasteners 20 and 21 preferably comprise a zipper and a side release buckle, respectively. Similar to side portion 16, side portion 18 is preferably flexible so as to permit front body portion 14 and back body portion 12 to move relative to one another along a mid-coronal plane of user 8. In the exemplary embodiment, side portion 18 includes a resiliently flexible material, such as NEOPRENE. Alternatively, more suitable materials, including LYCRA (a synthetic fiber produced by E.I. DuPont de Nemours and Company, Wilmington, Del.), DARLEXX (an elastic fabric produced by Darlington Fabrics Corporation, New York, N.Y.) or other stretch materials may be utilized. As a result, side portion 18 stretches to enable device 10 to better conform to the torso and chest of user 8. Although less desirable, side portion 18 may alternatively comprise non-resilient bands or straps of material such as nylon.

Side adjusters 22 and 24 and side adjusters 26 and 28 extend between back body portion 12 and front body portion 14 along side portions 16 and 18, respectively. Each side adjuster 22, 24, 26 and 28 preferably comprises an elongate non-resilient strap coupled adjacent to front body portion 14 and a slide buckle coupled adjacent to back body portion 12. Slide buckle (not shown) adjustably receives strap 72. Side adjusters 22, 24, 26 and 28 enable user 8 to vary the distance between back body portion 12 and front body portion 14 along sides 74 and 76 by adjusting the position of the buckle along its strap 72. Although less desirable, side adjusters 22, 24, 26 and 28 may be omitted.

Shoulder straps 30, 32 comprise elongate straps of material having ends 80, 82 affixed, preferably by stitching, to back body portion 12 and opposite ends 84, 86 affixed, preferably by stitching, to extension strap 34, respectively. Shoulder straps 30, 32 are generally non-stretchable and are configured to extend from back body portion 12 across opposite shoulders of user 8 and into sleeves 48 and 50, respectively, into and through sleeves 48 and 50 prior to converging into extension strap 34.

Extension strap 34 comprises an elongate strap of generally inelastic material affixed to ends 84 and 86 of shoulder straps 30 and 32, respectively, by stitching. Extension strap 34 extends from shoulder straps 30 and 32 through sleeve 52 and into connection with fastener 36. Extension strap 34 preferably has a length sufficient to accommodate differently sized users.

Fastener 36 is coupled to front face 62 of front body portion 14 along the mid-sagital plane of user 8 and is configured to engage extension strap 34 at various points to vary spacing between front body portion 14 and back body portion 12. In particular, fastener 36 is configured to selectively connect front body portion 14 to one of a plurality of spaced connecting portions along extension strap 34. As best shown by FIG. 3, fastener 36 preferably comprises a conventionally known slide buckle secured to front face 62 of front body portion 14 by connecting strap 90 which is stitched to layer 58 of front body portion 14. Fastener 36 is preferably configured such that extension strap 34 reverses its direction through fastener 36 so as to extend towards the head of user 8 from fastener 36. As a result, the length of extension strap 34 extending between shoulder straps 30, 32 and fastener 36 may be reduced by simply pulling on extension strap 34 in an upward direction towards the head of user 8.

Figure 4:
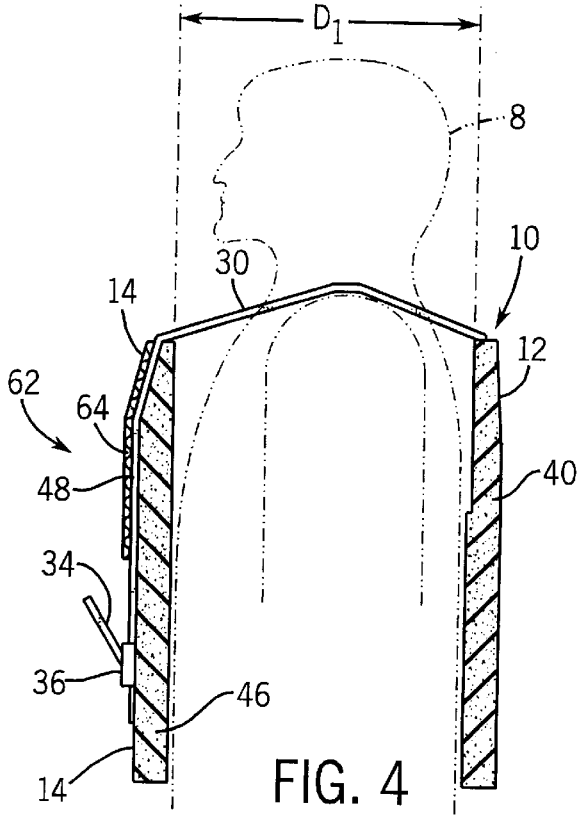
FIG. 4 is a side sectional view of the personal flotation device of FIG. 1 being worn by a user prior to adjustment.
Figure 5:
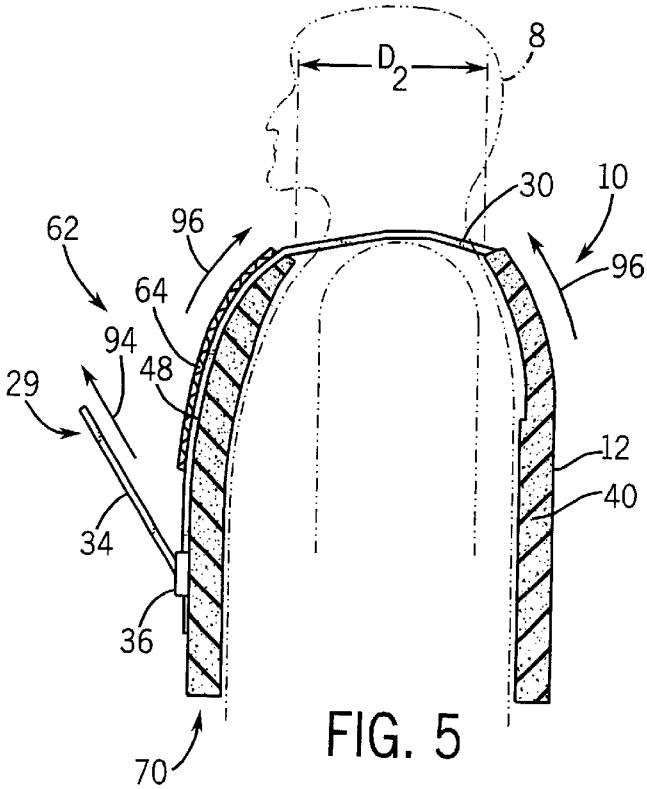
FIG. 5 is a side sectional view of the personal flotation device of FIG. 1 being worn by a user after adjustment.

FIGS. 4 and 5 are side sectional views of personal flotation device 10 being worn by user 8 and central pull system 29 being actuated by user 8. As shown by FIG. 4, prior to actuation of central pull system 29 by user 8, back body portion 12 and front body portion 14 are separated from one another by a distance D1. As shown by FIG. 5, user 8 may actuate central pull system 29 by simply pulling upward upon extension strap 34 in the direction indicated by arrow 94. As user 8 pulls extension strap 34 through fastener 36, shoulder straps 30 and 32 are also pulled in a downward direction through sleeves 48, 50 towards base 70 of device 10. As a result, the length of shoulder straps 30 and 32 extending between back body portion 12 and front body portion 14 is reduced by distance D1 to distance D2 shown in FIG. 5. This reduced distance causes upper portions of back body portion 12 and front body portion 14 to conform the user's body as indicated by arrows 96. Moreover, because side portions 16 and 18 are flexible, front body portion 14 may also move in an upward direction to a larger extent than that of back body portion 12 to better accommodate to the chest and torso of user 8. Although less desirable, device 10 may alternatively be provided with relatively inflexible side portions 16, 18, whereby back body portion 12 and front body portion 14 uniformly move vertically upward and downward together along the user as the extension strap is adjusted via fastener 36.

Overall, personal flotation device 10 quickly and easily adjusts to the particular size and shape of a user's torso. Because shoulder straps 30, 32 and extension strap 34 of central pull system 29 extend across face 62 of front body portion 14, central pull system 29 draws the upper portion of front body portion 14 against and into conformity with user's torso. Because side portions 16, 18 are flexible, central pull system 29 also adjusts and moves front body portion 14 relative to back body portion 12 to further accommodate differently configured torsos. Because fastener 36 is located along the user's mid-sagittal plane and is positioned relatively low on front body portion 14, strap 34 of central pull system 29 is easily grasped. Furthermore, because fastener 36 comprises a slide buckle or similar functioning fastener, central pull system 29 may be easily adjusted by the user by simply grabbing a single strap 34 and pulling upon strap 34 towards the user's head. Removal of personal flotation device 10 requires that strap 34 be pulled in a reverse direction through fastener 36.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A personal flotation device for being worn by a user, the device comprising:

a buoyant back body portion including flotation foam and configured to extend adjacent to the user's back;

a buoyant front body portion including flotation foam and configured to extend opposite the back portion adjacent to the user's front;

a first side body portion connecting the back portion and the front portion;

a second side body portion opposite the first side portion and connecting the back portion and the front portion;

a first shoulder strap having a first end and a second end, the first end being coupled to the back portion;

a second shoulder strap having a third end and a fourth end, the third end being coupled to the back portion, wherein the buoyant front body portion is movable along the first and second shoulder straps relative to the buoyant back body portion; and an extension strap having a first strap portion coupled to the second and fourth ends of the first and second shoulder straps, respectively, and a plurality of spaced connecting strap portions selectively connectable to the front portion to selectively adjust spacing between the buoyant back body portion and the buoyant front body portion.

2. The device of claim 1 wherein the first side portion and the second side portion are flexible so as to permit the front body portion and the back body portion to move relative to one another along a mid-coronal plane of a user wearing the device.

3. The device of claim 2, wherein the first side portion and the second side portion are elastic.

4. The device of claim 2, including a fastener connecting the extension strap to the front portion, wherein the fastener is configured such that the front body portion moves towards the user's head relative to the back portion when the extension strap is pulled towards the user's head.

5. The device of claim 1, including a fastener affixed to the front portion, wherein the fastener receives and releasably grips a selected one of the plurality of spaced connecting strap portions to enable the user to draw the front portion and the back portion closer to one another solely by pulling on the extension strap.

6. The device of claim 5, wherein the fastener comprises a slide buckle.

7. The device of claim 6, wherein the slide buckle is configured such that the extension strap is pulled towards the user's head to draw the front portion and the back portion towards one another.

8. The device of claim 5, wherein the fastener is configured such that the extension strap is pulled towards the user's head to draw the front portion and back portion towards one another.

9. The device of claim 1, wherein the front body portion includes an internally formed sleeve receiving and guiding the first and second shoulder straps.

10. The device of claim 1, wherein the first side portion is releasably coupled to the front body portion.

11. The device of claim 10, including a zipper releasably coupling the first side portion to the front body portion.

12. The device of claim 1, wherein the front body portion is generally triangularly shaped having a top corner and two side corners, the two side corners being coupled to the first and second side portions.

13. The device of claim 1, including a fastener coupled to the front body portion and configured to releasably engage and connect a selected one of the plurality of spaced connecting strap portions to the front portion, wherein the fastener is coupled to the front body portion at the user's mid-sagital plane when the device is worn by the user.

14. A personal flotation device comprising:

a buoyant back body portion;

a buoyant front body portion opposite the back portion;

first and second straps coupled to the back body portion and converging into a third strap, wherein the buoyant front body portion is movable along the first and second straps relative to the buoyant back body portion; and a fastener coupled to the front body portion and configured to engage the third strap at various points to vary spacing between the front body portion and the back body portion.

15. The device of claim 14, including a first and second opposite side portions extending between the back body portion and the front body portion.

16. The device of claim 15, wherein the first and second side portions are flexible so as to permit the front body portion and the back body portion to move relative to one another along a mid-coronal plane of a user wearing the device.

17. The device of claim 14, wherein the first side portion is releasably coupled to the front portion.

18. The device of claim 14, wherein the front body portion includes first and second spaced sleeves receiving and guiding the first and second straps, respectively.

19. A personal flotation device comprising:

a buoyant back body portion including at least one layer of flotation material;

a buoyant front body portion including at least one layer of flotation material, the front body portion extending opposite the back body portion;

a first side portion extending between the back body portion and the front body portion;

a second side portion extending from the back body portion and is releasably connected to the front body portion, the second side portion extending opposite the first side portion;

first and second shoulder straps coupled to the back body portion and converging into a third extension strap, wherein the buoyant front body portion is movable along the first and second shoulder straps relative to the buoyant back body portion; and a fastener coupled to the front body portion so as to extend along a user's mid-sagital plane when the device is worn by a user, the fastener being configured to selectively engage the third extension strap at various points to vary spacing between the front body portion and the back body portion.

20. The device of claim 19, wherein the front body portion includes first and second spaced sleeves receiving and guiding the first and second shoulder straps.

21. A personal flotation device for being worn by a user, the device comprising:

a buoyant back body portion including flotation foam and configured to extend adjacent to the user's back;

a buoyant front body portion including flotation foam and configured to extend opposite the back portion adjacent to the user's front;

a first side body portion connecting the back portion and the front portion;

a second side body portion opposite the first side portion and connecting the back portion and the front portion, wherein the first side portion and the second side portion are flexible so as to permit the front body portion and the back body portion to move relative to one another along a mid-coronal plane of a user wearing the device;

a first shoulder strap having a first end and a second end, the first end being coupled to the back portion;

a second shoulder strap having a third end and a fourth end, the third end being coupled to the back portion;

an extension strap having a first strap portion coupled to the second and fourth ends of the first and second shoulder straps, respectively, and a plurality of spaced connecting strap portions selectively connectable to the front portion to selectively adjust spacing between the buoyant back body portion and the buoyant front body portion; and a fastener connecting the extension strap to the front portion, wherein the fastener is configured such that the front body portion moves towards the user's head relative to the back portion when the extension strap is pulled towards the user's head.

22. A personal flotation device for being worn by a user, the device comprising:

a buoyant back body portion including flotation foam and configured to extend adjacent to the user's back;

a buoyant front body portion including flotation foam and configured to extend opposite the back portion adjacent to the user's front;

a first side body portion connecting the back portion and the front portion;

a second side body portion opposite the first side portion and connecting the back portion and the front portion;

a first shoulder strap having a first end and a second end, the first end being coupled to the back portion;

a second shoulder strap having a third end and a fourth end, the third end being coupled to the back portion;

an extension strap having a first strap portion coupled to the second and fourth ends of the first and second shoulder straps, respectively, and a plurality of spaced connecting strap portions selectively connectable to the front portion to selectively adjust spacing between the buoyant back body portion and the buoyant front body portion; and a fastener affixed to the front portion, wherein the fastener receives and releasably grips a selected one of the plurality of spaced connecting strap portions to enable the user to draw the front portion and the back portion closer to one another solely by pulling on the extension strap, wherein the fastener comprises a slide buckle; and wherein the slide buckle is configured such that the extension strap is pulled towards the user's head to draw the front portion and the back portion towards one another.

23. A personal flotation device for being worn by a user, the device comprising:

a buoyant back body portion including flotation foam and configured to extend adjacent to the user's back;

a buoyant front body portion including flotation foam and configured to extend opposite the back portion adjacent to the user's front;

a first side body portion connecting the back portion and the front portion;

a second side body portion opposite the first side portion and connecting the back portion and the front portion;

a first shoulder strap having a first end and a second end, the first end being coupled to the back portion;

a second shoulder strap having a third end and a fourth end, the third end being coupled to the back portion;

an extension strap having a first strap portion coupled to the second and fourth ends of the first and second shoulder straps, respectively, and a plurality of spaced connecting strap portions selectively connectable to the front portion to selectively adjust spacing between the buoyant back body portion and the buoyant front body portion; and a fastener affixed to the front portion, wherein the fastener receives and releasably grips a selected one of the plurality of spaced connecting strap portions to enable the user to draw the front portion and the back portion closer to one another solely by pulling on the extension strap, wherein the fastener is configured such that the extension strap is pulled towards the user's head to draw the front portion and back portion towards one another.

24. A personal flotation device for being worn by a user, the device comprising:

a buoyant back body portion including flotation foam and configured to extend adjacent to the user's back;

a buoyant front body portion including flotation foam and configured to extend opposite the back portion adjacent to the user's front;

a first side body portion connecting the back portion and the front portion;

a second side body portion opposite the first side portion and connecting the back portion and the front portion;

a first shoulder strap having a first end and a second end, the first end being coupled to the back portion;

a second shoulder strap having a third end and a fourth end, the third end being coupled to the back portion, wherein the front body portion includes an internally formed sleeve receiving and guiding the first and second shoulder straps; and an extension strap having a first strap portion coupled to the second and fourth ends of the first and second shoulder straps, respectively, and a plurality of spaced connecting strap portions selectively connectable to the front portion to selectively adjust spacing between the buoyant back body portion and the buoyant front body portion.

25. A personal flotation device comprising:

a buoyant back body portion;

a buoyant front body portion opposite the back portion;

first and second straps coupled to the back body portion and converging into a third strap, wherein the front body portion includes first and second spaced sleeves receiving and guiding the first and second straps, respectively; and a fastener coupled to the front body portion and configured to engage the third strap at various points to vary spacing between the front body portion and the back body portion.

* * * * *